US008618723B2

(12) United States Patent
Sakai et al.

(10) Patent No.: US 8,618,723 B2
(45) Date of Patent: Dec. 31, 2013

(54) LUMINAIRE

(75) Inventors: Makoto Sakai, Kanagawa-ken (JP); Takumi Suwa, Kanagawa-ken (JP); Shinji Nakata, Kanagawa-ken (JP); Michinobu Inoue, Kanagawa-ken (JP); Izuru Komatsu, Kanagawa-ken (JP); Daigo Suzuki, Kanagawa-ken (JP); Kumiko Ioka, Chiba-ken (JP); Kazuki Tateyama, Kanagawa-ken (JP); Yasuhide Okada, Kanagawa-ken (JP)

(73) Assignees: Toshiba Lighting & Technology Corporation, Kanagawa (JP); Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 13/602,055

(22) Filed: Aug. 31, 2012

(65) Prior Publication Data

US 2013/0063942 A1 Mar. 14, 2013

(30) Foreign Application Priority Data

Sep. 9, 2011 (JP) ..... 2011-197723

(51) Int. Cl.
*H01J 1/02* (2006.01)

(52) U.S. Cl.
USPC ..... 313/46; 313/45; 313/512

(58) Field of Classification Search
USPC ..... 313/46, 498, 512, 493, 634, 318.01
See application file for complete search history.

(56) References Cited

U.S. PATENT DOCUMENTS

| | | | |
|---|---|---|---|
| 2010/0073944 A1 | 3/2010 | Chen | |
| 2011/0169394 A1 * | 7/2011 | Chowdhury et al. | 313/46 |

FOREIGN PATENT DOCUMENTS

| | | |
|---|---|---|
| JP | 2005-166578 | 6/2005 |
| JP | 2008-186758 | 8/2008 |
| WO | 2010/058325 | 5/2010 |
| WO | WO 2011/089069 A2 | 7/2011 |

OTHER PUBLICATIONS

European Search Report, issued in counterpart European patent application No. 12182503.8 dated Feb. 19, 2013, 11 pages.

* cited by examiner

*Primary Examiner* — Vip Patel
(74) *Attorney, Agent, or Firm* — Patterson & Sheridan, LLP.

(57) ABSTRACT

A luminaire according to embodiments includes a body portion, a light source provided at one end portion of the body portion and having a light-emitting element, a globe provided so as to cover the light source, and a thermal transfer portion thermally joined to at least either one of the globe or a thermal radiating surface of the body portion on the end portion side. Then, an end surface of the thermal transfer portion on the side of the globe is exposed from the globe.

20 Claims, 11 Drawing Sheets

LUMINAIRE

CROSS-REFERENCE TO RELATED APPLICATIONS

This application is based upon and claims the benefit of priority from the prior Japanese Patent Application No. 2011-197723, filed on Sep. 9, 2011; the entire contents of which are incorporated herein by reference.

FIELD

Embodiments described herein relate generally to a luminaire.

BACKGROUND

In recent years, a luminaire employing light-emitting diodes (LEDs) in a light source instead of incandescent lamps (filament lamps) is put to practical use.

Since the luminaire employing the light-emitting diodes has a long life-span and may be configured to use less power, replacement of the existing incandescent lamp by the luminaire with the light-emitting diodes is expected.

In the luminaire employing the light-emitting diodes as described above, a structure in which heat generated by the light source is radiated to the outside via a body portion is proposed.

DETAILED DESCRIPTION

Figure 1A:
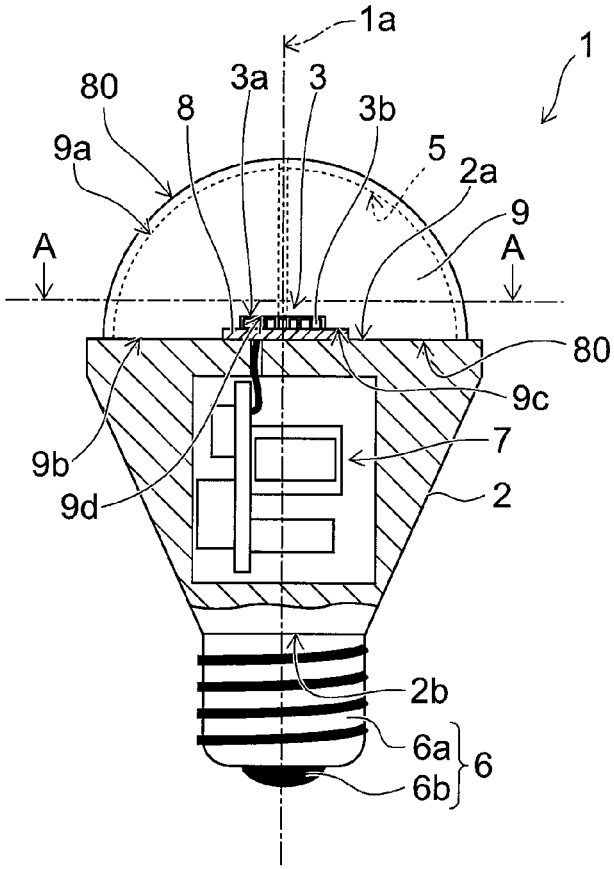
FIG. 1A is a schematic partial cross-sectional view illustrating a luminaire according to a first embodiment.

A luminaire according to embodiments includes a body portion, a light source provided on one of end portions of the body portion and having light-emitting elements, a globe provided so as to cover the light source, and a thermal transfer portion thermally joined to at least one of the globe and a thermal radiating surface of the body portion on the side of the end portion. Then, an end surface of the thermal transfer portion on the side of the globe is exposed from the globe.

Referring now to the respective drawings, embodiments will be described. In the drawings, the same components are designated by the same reference numerals and detailed description will be omitted as needed.

[First Embodiment]

Figure 1B:
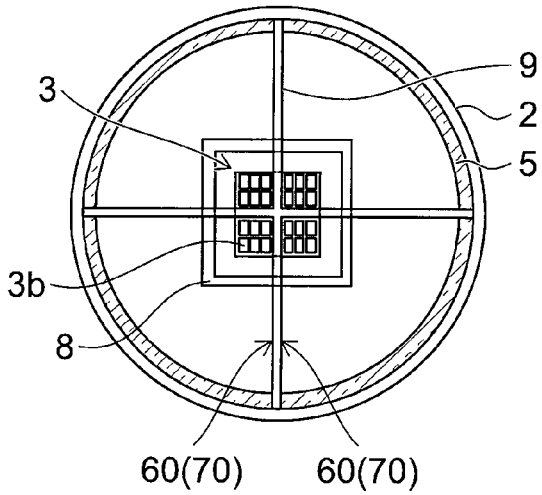
FIG. 1B is a cross-sectional view taken along the line A-A in FIG. 1A.

FIGS. 1A and 1B are schematic drawings illustrating a luminaire according to a first embodiment.

FIG. 1A is a schematic partial cross-sectional view of the luminaire, and FIG. 1B is a cross-sectional view taken along the line A-A in FIG. 1A.

Figure 2:
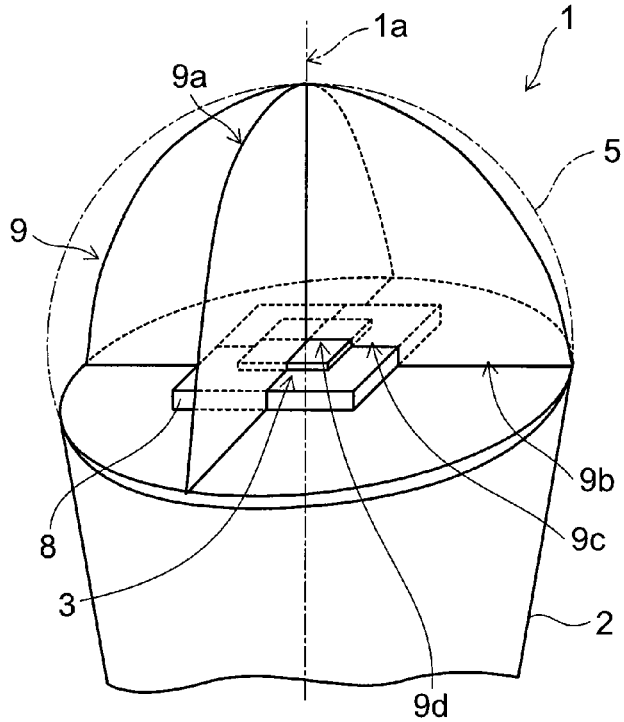
FIG. 2 is a schematic perspective view illustrating a thermal transfer portion.

FIG. 2 is a schematic perspective view illustrating a thermal transfer portion.

As illustrated in FIG. 1A, a luminaire 1 includes a body portion 2, a light source 3, a globe 5, a cap portion 6, a control unit 7, and a thermal transfer portion 9.

The body portion 2 may be formed into a shape, for example, gradually increasing in cross-sectional area in a direction perpendicular to an axial direction as it goes from the cap portion 6 side to the globe 5 side. However, the shape of the body portion 2 is not limited thereto and may be modified as needed in accordance with, for example, the size of the light source 3 or the globe 5, or the size of the cap portion 6. In this case, by employing a shape approximate to a neck portion of an incandescent lamp, replacement of the existing incandescent lamp by the luminaire 1 is facilitated.

The body portion 2 may be formed of a material having a high rate of thermal transfer, for example. The body portion 2 may be formed of, for example, a metal such as aluminum (Al), copper (Cu), and an alloy thereof. However, the material of the body portion 2 is not limited thereto, and may be formed of an inorganic material such as aluminum nitride (AlN), and alumina ($Al_2O_3$) or an organic material such as a high thermal conductive resin.

The light source 3 is provided at the center of one end portion 2*a* of the body portion 2. An irradiating surface 3*a* of the light source 3 is provided so as to be perpendicular to a center axis 1*a* of the luminaire 1 and radiates light mainly in the axial direction of the luminaire 1. The light source 3 may have, for example, a plurality of light-emitting elements 3*b*. However, the number of the light-emitting elements 3*b* may be changed as needed, so that one or more light-emitting elements 3*b* may be provided according an application of the luminaire 1 or the size of the light-emitting elements 3*b*.

The light-emitting element 3*b* may be so called a self-light-emitting element such as a light-emitting diode, an organic light-emitting diode, and a laser diode. When the plurality of light-emitting elements 3*b* are provided, a regularly disposed form such as a matrix pattern, a zigzag pattern, or a radial pattern may be employed, or an arbitrarily disposed form is also applicable.

The globe 5 is provided on the end portion 2*a* side of the body portion 2 so as to cover the light source 3. The globe 5 may have a curved surface projecting in the direction of radiation of light.

The globe 5 is divided corresponding to areas partitioned by the thermal transfer portion 9, so that an end surface of the thermal transfer portion 9 is exposed from the globe 5.

The globe 5 has translucency, and is configured to allow light radiated from the light source 3 to go outside from the luminaire 1. The globe 5 may be formed of a material having translucency and, for example, may be formed of glass, a transparent resin such as polycarbonate, or a translucent ceramics. If needed, applying a diffusing agent or a fluorescent material on an inner surface of the globe 5, or impregnating the diffusing agent or the fluorescent material in the interior of the globe 5 (kneading the diffusing agent or the fluorescent material into the translucent material) is also conceivable.

The cap portion 6 is provided at an end portion 2*b* of the body portion 2 opposite the side on which the globe 5 is provided. The cap portion 6 may have a shape which is fixturable to a socket to which the incandescent lamp is mounted. The cap portion 6 may have the same shape as, for example, E26-type or E17-type prescribed in JIS Standard. However, the shape of the cap portion 6 is not limited to those described above, but may be modified as needed. For example, the cap portion 6 may be configured to have pin-type terminals used for fluorescent lamps, or may have L-shaped terminals used for a ceiling plug.

The cap portion 6 illustrated in FIG. 1A includes a cylindrical shell portion 6*a* having a thread formed thereon and an eyelet portion 6*b* provided on an end portion of the shell portion 6*a* opposite an end portion provided on the side of the body portion 2. The control unit 7, described later, is electrically connected to the shell portion 6*a* and the eyelet portion 6*b*.

The control unit 7 is provided in a space formed in the interior of the body portion 2.

The control unit 7 may have an illumination circuit configured to supply power to the light source 3. The control unit 7 may also have a light modulating circuit configured to modulate light of the light source 3.

A substrate 8 is provided between the light source 3 and the body portion 2.

The substrate 8 may be formed of a material having a high rate of thermal transfer, for example. The body portion 8 may be formed of, for example, a metal such as aluminum (Al), copper (Cu), and an alloy thereof, and formed with a wiring pattern, not illustrated, on a surface thereof via an insulating layer. The material of the substrate 8 is not limited to those described above, but may be modified as needed. For example, the substrate 8 may be formed with the wiring pattern on a surface of a base material using a resin. The substrate 8 may employ the base material of an inorganic material such as aluminum nitride (AlN) or an organic material such as a high-thermal conductive resin. However, by using the substrate 8 formed of a material having a high rate of thermal transfer, heat generated by the light source 3 may be released to the outside easily via the substrate 8 and the body portion 2. As described later, the heat generated by the light source 3 may be released easily to the outside via the substrate 8, the thermal transfer portion 9, and the globe 5. Detailed description relating to the thermal release via the substrate 8, the thermal transfer portion 9, and the globe 5 will be given later.

Here, the heat generated by the light source 3 is released to the outside via the substrate 8 and the body portion 2.

However, when increasing power to be supplied to the light source 3 in order to further increase luminous energy of the luminaire 1, a sufficient cooling effect may not be obtained only by radiating the heat from the body portion 2 side.

If the light-emitting elements 3*b* are used for the light source 3, there arises a problem of decrease in a light distribution angle in comparison with the incandescent lamp. In this case, the light distribution angle may be increased by forming the globe 5 to have a substantially spherical shape. However, if the globe 5 is formed to have the substantially spherical shape, the size of the body portion 2 is decreased as described later, so that the sufficient cooling effect may not be obtained only by radiating the heat from the body portion 2 side.

Figures 3A, 3B:
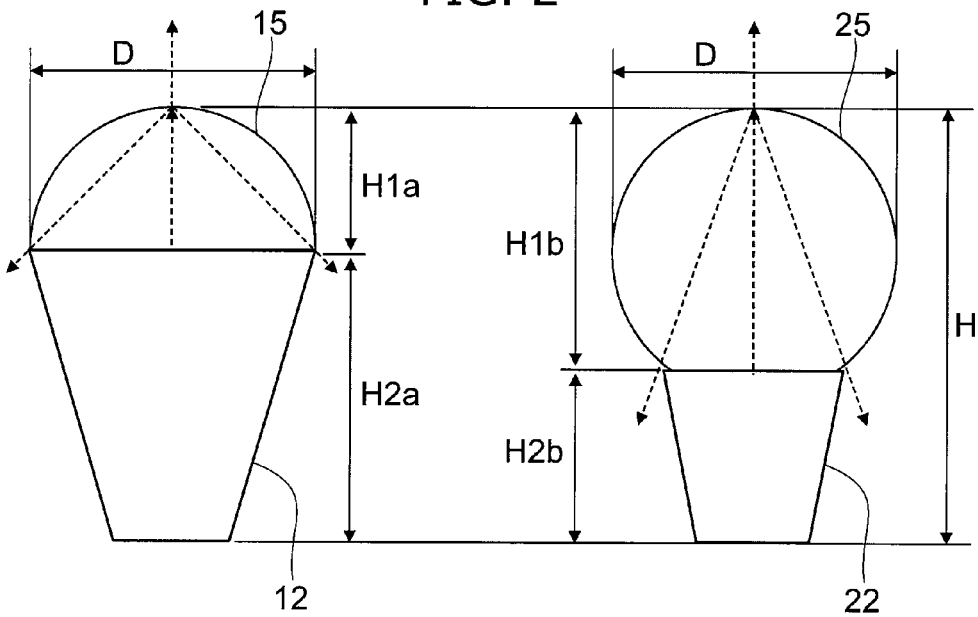
FIG. 3A is a schematic drawing illustrating a relationship between the shape of a globe and a light distribution angle when the globe has a semi-spherical shape.
FIG. 3B is a schematic drawing illustrating a relationship between the shape of the globe and the light distribution angle when the globe has a substantially spherical shape.

FIGS. 3A and 3B are schematic drawings illustrating a relationship between the shape of the globe and the light distribution angle.

FIG. 3A illustrates a globe 15 having a semi-spherical shape, and FIG. 3B shows a globe 25 having a substantially spherical shape.

Arrows in the drawings indicate the directions of travel of light. In this case, in order to avoid the drawings becoming complicated, only elements required for explaining the light distribution angle are illustrated as representatives.

Considering now the replacement of the existing incandescent lamp with the luminaire 1, an outline dimension of the luminaire 1 is preferably the same as that of the incandescent lamp as much as possible. Therefore, in FIGS. 3A and 3B, the globes 15 and 25 are set to D in diameter and the luminaire is set to H in height, and these dimensions are set to be substantially the same as those of corresponding parts of the incandescent lamp.

As illustrated in FIG. 3B, if the globe 25 is formed to have the substantially spherical shape, the luminaire 1 may radiate further backward than the case of the globe 15 having the semi-spherical shape illustrated in FIG. 3A. Consequently, the light distribution angle may be increased.

However, by forming the globe 25 in the substantially spherical shape, a height H1*b* of the globe 25 becomes larger than a height H1*a* of the globe 15. In contrast, since the height H of the luminaire is constant, a height H2*b* of a body portion 22 becomes smaller than a height H2*a* of a body portion 12. In other words, the closer to the spherical shape the globe 5 becomes to increase the light distribution angle, the smaller the size of the body portion 2 becomes, which may impair easy thermal radiation from the body portion 2 side.

In this manner, when an attempt is made to improve basic performances of the luminaire such as increase in luminous energy or widening of the light distribution angle, a sufficient cooling effect may not be obtained only by the thermal radiation from the body portion 2 side.

Therefore, in the first embodiment, the amount of thermal radiation to the globe 5 side is increased by providing the thermal transfer portion 9.

The thermal transfer portion 9 is thermally joined to either one of the globe 5 or a thermal radiating surface of the body portion 2 on the side of the end portion 2*a*.

In this case, as illustrated in FIG. 1A and FIG. 2, the thermal transfer portion 9 may include an end portion 9*a* thermally joined to the globe 5 at least partly, an end portion 9*b* thermally joined to the end portion 2*a* of the body portion 2 at least partly, an end portion 9*c* thermally joined to the substrate 8 at least partly, and an end portion 9*d* thermally joined to the irradiating surface 3*a* of the light source 3 at least partly.

However, all of the end portions 9*a* to 9*c* do not have to be provided as long as at least the end portion 9*a* is provided.

In this specification, the expression "thermally joined" means that heat is transferred between the thermal transfer portion 9 and the counterpart member by at least any one of thermal conduction, convection, and radiation.

For example, the heat may be transferred by the thermal conduction by bringing the thermal transfer portion 9 into contact with the counterpart member, or the heat may be transferred by the convection or the radiation by providing a small gap with respect to the thermal transfer portion 9.

In other words, the end portion 9*a*, the end portion 9*b*, the end portion 9*c*, and the end portion 9*d* of the heat transfer portion 9 may be brought into contact with the counterpart member or may be separated therefrom by an extent which achieves the thermal transfer.

In this case, since employing the thermal conduction improves the thermal radiating effect, the end portion 9*a*, the end portion 9*b*, the end portion 9*c*, and the end portion 9*d* of the thermal transfer portion 9 are preferably brought into contact with the counterpart member.

The thermal joint does not necessarily have to be performed in the entire areas of the end portion 9*a*, the end portion 9*b*, the end portion 9*c*, and the end portion 9*d*, and only have to be performed at least partly.

In this case, the thermal joint is preferably performed in areas as wide as possible.

At least anyone of the end portion 2*a* of the body portion 2, the substrate 8, and the irradiating surface 3*a* of the light source 3 serves as the thermal radiating surface on the side of the end portion 2*a* of the body portion 2. Therefore, an end portion of the thermal transfer portion 9 which is thermally joined at least partly to at least any one of these thermal radiating surfaces may be provided.

A joint portion 80 containing a material having a high rate of thermal transfer may be provided between at least part of the end portions 9*b*, 9*c*, and 9*d* and the thermal radiating surface on the side of the end portion 2*a*.

For example, the joint portion 80 may be provided by joining the end portion 2*a* of the body portion 2 and the end portion 9*b* by soldering or the like. Alternatively, for example, the joint portion 80 may be provided by joining, for example, the substrate 8 and the end portion 9*c* by soldering or the like. Furthermore, for example, the joint portion 80 may be provided by joining the irradiating surface 3*a* of the light source 3 and the end portion 9*d* by, for example, a high-conductive adhesive agent added with ceramics filler or metal filler or the like having a high rate of thermal transfer.

Also, the joint portion 80 containing a material having a high rate of thermal transfer may be provided between the globe 5 and the end portion 9*a*.

The joint portion 80 may be provided by joining the globe 5 and the end portion 9*a* by, for example, the high-conductive adhesive agent added with ceramics filler or metal filler having a high rate of thermal transfer.

It is also possible just to bring the end portion of the thermal transfer portion 9 and the counterpart into contact with each other to achieve the thermal joint therebetween. However, by joining the end portion of the thermal transfer portion 9 and the counterpart via the joint portion 80 containing a material having a high rate of thermal transfer, the thermal resistance may be reduced, and hence the cooling effect described later may be improved.

Also, a gap may be formed between the end portion of the thermal transfer portion 9 and the counterpart at the time of joining. Since the thermal resistance is increased when the gap is formed, the thermal resistance may be reduced by joining via the joint portion 80 even when the gap is formed.

The thermal transfer portion 9 may be formed of a material having a high rate of thermal transfer. The thermal transfer portion 9 may be formed of, for example, a metal such as aluminum (Al), copper (Cu), and an alloy thereof. However, the material of the thermal transfer portion 9 is not limited thereto, and may be formed of an inorganic material such as aluminum nitride (AlN) or an organic material such as a high thermal conductive resin.

The end portion of the thermal transfer portion 9 on the globe 5 side may be provided with a level difference.

A gap due to a production error or the like may be formed between the thermal transfer portion 9 and the globe 5. When the gap is formed between the thermal transfer portion 9 and the globe 5, light irradiated from the light source 3 may be leaked from the gap, or dust existing on the outside may enter into the inside of the globe 5 from the gap.

Therefore, the level difference is provided at the end portion of the thermal transfer portion 9 on the globe 5 side.

FIG. 4A to FIG. 4D are partially enlarged schematic drawings illustrating shoulder portions 9*f* provided at a portion of the thermal transfer portion 9 having the level difference.

Figure 4A:
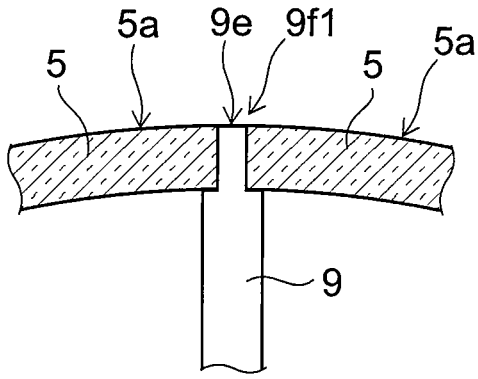
FIG. 4A to FIG. 4D are partially enlarged schematic drawing illustrating shoulder portions provided at the thermal transfer portion having a level difference.

For example, as illustrated in FIG. 4A, a shoulder portion 9*f*1 may have a form of a depression depressed in the direction of the thickness of the thermal transfer portion 9. By employing the shoulder portion 9*f*1 having the depressed form, the thermal transfer portion 9 and the globe 5 may be overlapped with each other at the depressed portion. Therefore, leaking of light irradiated from the light source 3 from the gap, or entering of dust existing on the outside into the inside of the globe 5 from the gap may be inhibited. Also, assembling of the globe 5 may be facilitated. In this case, an end surface 9*e* of the thermal transfer portion 9 and an outer peripheral surface 5*a* of the globe 5 are preferably flush with each other.

Figure 4B:
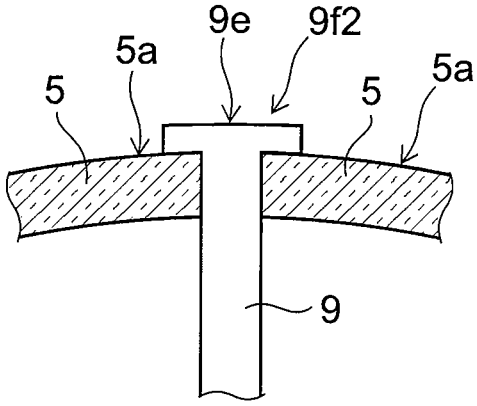
Figure 4C:
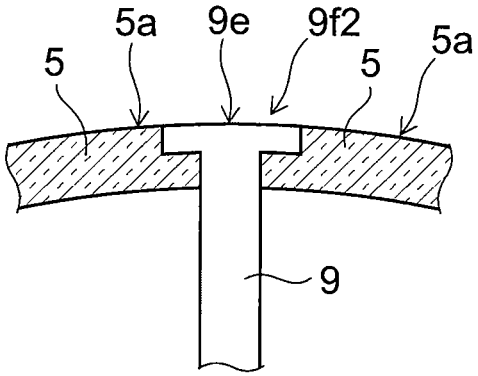

Also, for example, as illustrated in FIGS. 4B and 4C, a shoulder portion 9*f*2 may have a projecting form projecting in the direction of the thickness of the thermal transfer portion 9. By employing the shoulder portion 9*f*2 having the projecting form, the thermal transfer portion 9 and the globe 5 may be overlapped with each other at the projecting portion. Therefore, leaking of light irradiated from the light source 3 from the gap, or entering of dust existing on the outside into the inside of the globe 5 from the gap may be inhibited. Also, assembling of the globe 5 may be facilitated.

In this case, as illustrated in FIG. 4C, the end surface 9*e* of the thermal transfer portion 9 and the outer peripheral surface 5*a* of the globe 5 are preferably flush with each other.

Figure 4D:
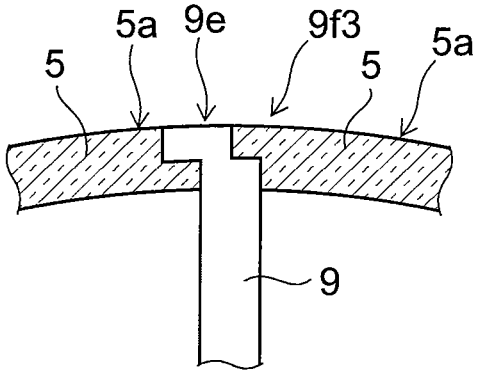

Also, for example, as illustrated in FIG. 4D, a shoulder portion 9*f*3 may have the depressed form as well as the projecting form.

In other words, the thermal transfer portion 9 may have a shoulder portion having at least either one of the projecting form projecting in the direction of the thickness of the thermal transfer portion 9 or the depressed form depressed in the direction of the thickness of the thermal transfer portion 9 at the end portion on the globe 5 side.

Here, when the thermal transfer portion 9 is simply provided on the inside of the globe 5, the difference between a bright section and a dark section generated on the globe 5 is increased, so that an uneven brightness of the luminaire 1 may be increased. Therefore, the thermal transfer portion 9 is configured to be capable of reflecting light radiated from the light source 3.

In this case, for example, the thermal transfer portion 9 may have a higher reflectance than that of the globe 5.

The thermal transfer portion 9 may have, for example, a reflecting layer 60 on a surface thereof.

The reflecting layer 60 may be a layer formed by applying, for example, a white coating material. In this case, the coating material used for the white coating preferably has resistance to heat generated by the luminaire 1 and resistance to light radiated from the light source 3. Examples of the coating materials as described above include, for example, a polyester-resin-based white coating material, an acrylic-resin-based white coating material, an epoxy-resin-based white coating material, a silicone-resin-based white coating material, a urethane-resin-based white coating material containing at least one of white pigments such as titanium oxide ($TiO_2$), zinc oxide (ZnO), barium sulfate ($BaSO_4$), and magnesium oxide (MgO), or a combination of two or more of the white coating materials selected therefrom.

However, the reflecting layer 60 is not limited thereto and, for example, a layer formed by coating a metal such as silver or aluminum having a high reflectance by a plating method, an evaporation method, or a sputtering method or a layer formed by cladding the same with a base material may also be applicable.

The thermal transfer portion 9 itself may be formed of a material having a high reflectance.

Figure 5:
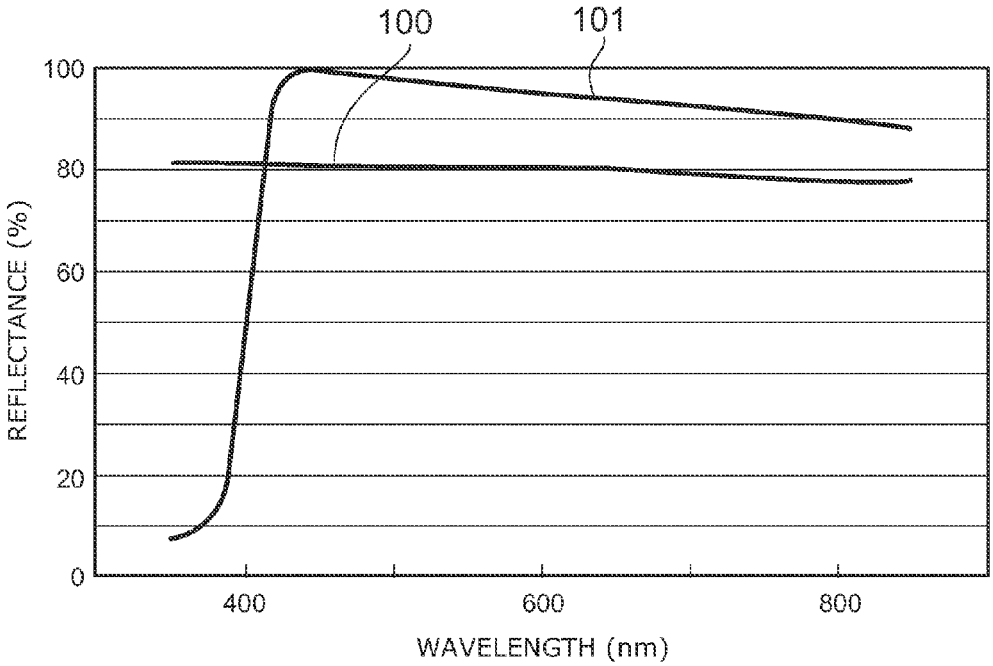
FIG. 5 is a graph illustrating a reflectance of a reflecting layer.

FIG. 5 is a graph illustrating a reflectance of the reflecting layer.

A line 100 in FIG. 5 shows a case of a reflecting layer formed of a rolled plate of aluminum (A1050 prescribed in JIS standard), and a line 101 shows a case of a reflecting layer formed by applying the polyester-resin-based white coating material.

When providing the reflecting layer 60 or forming the thermal transfer portion 9 itself of a material having a high reflectance, the reflectance with respect to light radiated from the light source 3 is preferably 90% or higher, and more preferably 95% or higher. The reflectance in this specification is based on light having a wavelength of at least approximately 460 nm or approximately 570 nm.

Therefore, the reflecting layer 60 is preferably formed by applying the polyester-resin-based white coating material.

Assuming that the thermal transfer portion 9 is capable of reflecting light radiated from the light source 3, the difference between the bright section and the dark section generated on the globe 5 may be reduced, so that the uneven brightness of the luminaire 1 may be reduced. Also, the light distribution angle of the luminaire 1 may be widened.

The thermal transfer portion 9 may have a form of a plate shape, or a form of a plurality of plate-shaped members intersecting each other. For example, the thermal transfer portion 9 illustrated in FIG. 1 and FIG. 2 has a form of two plate-shaped members intersecting into a cross shape.

The thermal transfer portion 9 may have a form of rotation symmetry with respect to an optical axis of the luminaire 1.

In this case, as illustrated in FIG. 1, when the center of the end portion 2*a* of the body portion 2 and the center of the light source 3 overlap in plain view, the center axis 1*a* of the luminaire 1 corresponds to the optical axis of the luminaire 1.

Therefore, in the case of the luminaire 1 illustrated in FIG. 1, the thermal transfer portion 9 may have a form of rotation symmetry with respect to the center axis 1*a* of the luminaire 1.

Assuming that the thermal transfer portion 9 has a form of rotation symmetry with respect to the optical axis of the luminaire 1, the brightness in the areas partitioned by the thermal transfer portion 9 may be equalized with respect to each other.

Therefore, the difference between the bright section and the dark section generated on the globe 5 may be reduced, so that the uneven brightness of the luminaire 1 may be reduced.

Figure 6A:
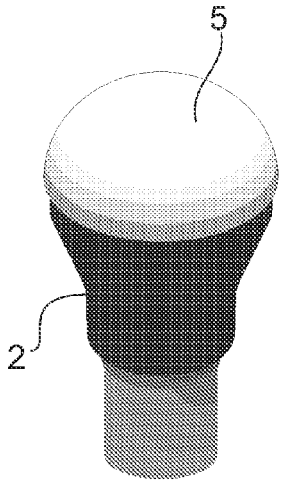
FIG. 6A is a schematic drawing illustrating a temperature distribution of the luminaire which is not provided with the thermal transfer portion.
Figure 6B:
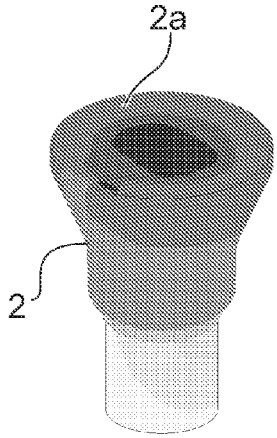
FIG. 6B is a schematic drawing illustrating the temperature distribution in the vicinity of an end portion of a body portion of the luminaire which is not provided with the thermal transfer portion.

FIGS. 6A and 6B are schematic drawings illustrating a state of thermal radiation in the luminaire which is not provided with the thermal transfer portion.

FIG. 6A is a schematic drawing illustrating a temperature distribution of the luminaire, and FIG. 6B is a schematic drawing illustrating the temperature distribution in the vicinity of the end portion 2*a* of the body portion 2.

Figure 7A:
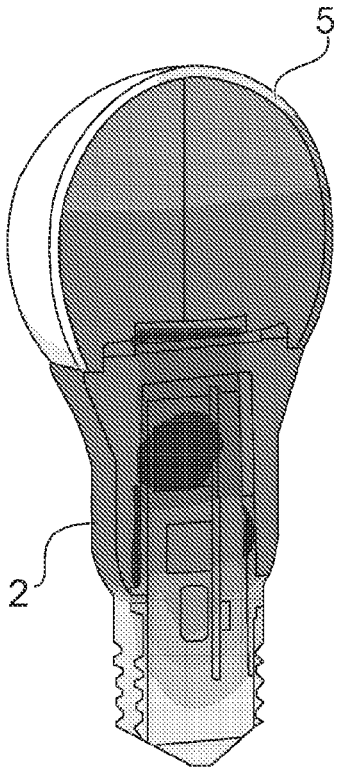
FIG. 7A is a schematic drawing illustrating the state of thermal radiation when an inner surface of the globe and an end surface of the thermal transfer portion are in contact with each other (when the end surface of the thermal transfer portion is not exposed from the globe) in the luminaire which is provided with the thermal transfer portion.
Figure 7B:
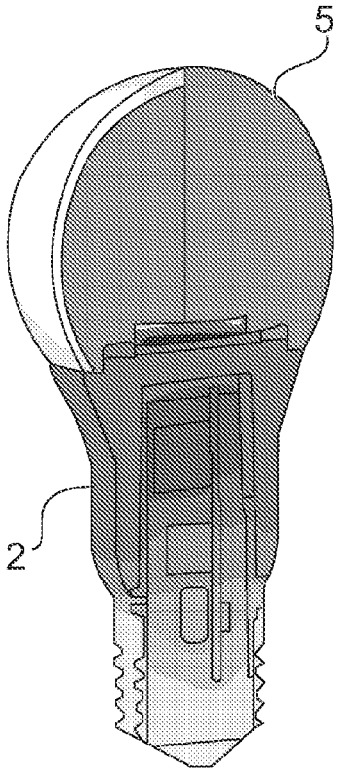
FIG. 7B is a schematic drawing illustrating the state of thermal radiation when the end surface of the thermal transfer portion is exposed from the globe in the luminaire which is provided with the thermal transfer portion.

FIGS. 7A and 7B are schematic drawings illustrating a state of thermal radiation in the luminaire which is provided with the thermal transfer portion.

FIG. 7A shows a case where the inner surface of the globe 5 and the end surface of the thermal transfer portion are in contact with each other (when the end surface of the thermal transfer portion is not exposed from the globe 5), and FIG. 7B shows a case where the end surface of the thermal transfer portion 9 is exposed from the globe 5.

FIGS. 6A and 6B and FIGS. 7A and 7B are drawings of the temperature distribution of the luminaire obtained by simulation, and a case where an output from the light source 3 is set to approximately 5 W (watt) and the environment temperature is set to approximately 25° C.

The temperature distribution is indicated by shading of monotone color, and is shown so as to be deeper with increase in temperature and lighter with decrease in temperature.

When the thermal transfer portion 9 is not provided, as illustrated in FIG. 6A, the surface temperature of the globe 5 is lowered, and the temperature of the body portion 2 increases.

In this case, as illustrated in FIG. 6B, the temperature in the vicinity of the end portion 2*a* of the body portion 2 is increased.

In other words, it is understood that when the thermal transfer portion 9 is not provided, the heat generated by the light source 3 is released from the body portion 2 side and the release of heat from the globe 5 side is small. As illustrated in FIG. 6B, it is understood that the sufficient cooling effect is not obtained only by the thermal radiation from the body portion 2 side.

In contrast, when the thermal transfer portion 9 is provided, the heat generated by the light source 3 may be transferred to the globe 5 side by the thermal transfer portion 9. Therefore, as illustrated in FIGS. 7A and 7B, the temperature of the body portion 2 may be lowered by thermal radiation from the globe 5 side.

Furthermore, when the end surface of the thermal transfer portion 9 is exposed from the globe 5, the temperature of the body portion 2 may further be decreased as illustrated in FIG. 7B.

Lowering of the temperature of the body portion 2 means that increase in temperature of the light-emitting elements 3*b* is inhibited. Therefore, the power to be supplied to the light source 3 may be increased, and hence the increase in luminous energy is achieved.

According to this embodiment, since the heat may be released from the globe 5 side via the thermal transfer portion 9, the thermal radiating property of the luminaire 1 may be improved. Therefore, elongation of the life-span of the luminaire 1 is achieved. In addition, the basic performance of the luminaire 1 such as the increase in luminous energy and the widening of the light distribution angle are improved.

Assuming that the thermal transfer portion 9 is capable of reflecting light radiated from the light source 3, the difference between the bright section and the dark section generated on the globe 5 may be reduced, so that the uneven brightness of the luminaire 1 may be reduced.

Assuming that the thermal transfer portion 9 has a form of rotation symmetry with respect to the optical axis of the luminaire 1, the difference between the bright section and the dark section generated on the globe 5 may be reduced, so that the uneven brightness of the luminaire 1 may be reduced.

[Second Embodiment]

Figure 8A:
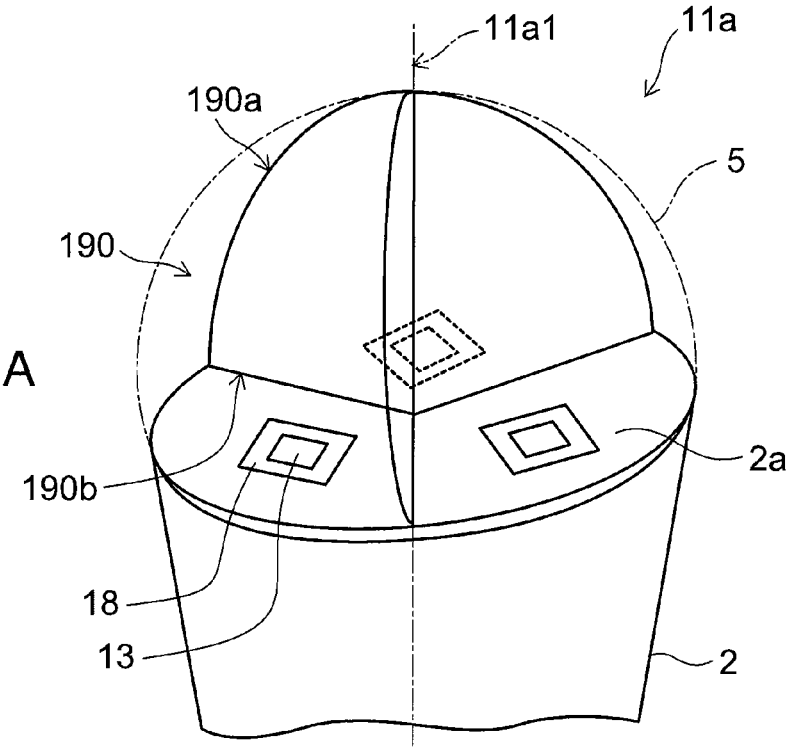
FIG. 8A is a schematic perspective view illustrating a luminaire according to a second embodiment, and illustrating a thermal transfer portion having light sources arranged planarly.
Figure 8B:
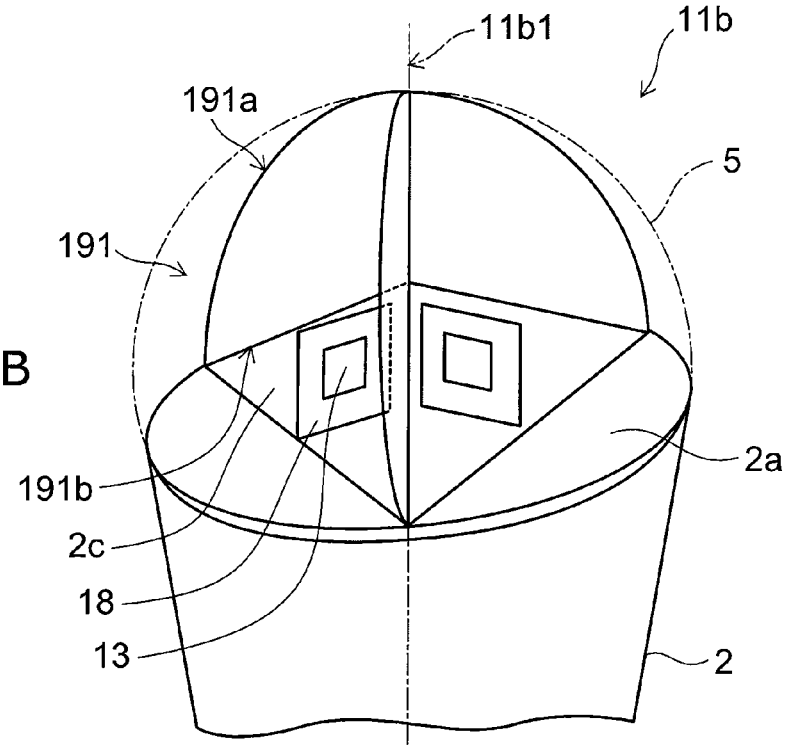
FIG. 8B is a schematic perspective view illustrating the thermal transfer portion having the light sources arranged sterically.

FIGS. 8A and 8B are schematic perspective views illustrating a luminaire according to a second embodiment.

FIG. 8A is a schematic perspective view illustrating a thermal transfer portion in which light sources are arranged flatly; and FIG. 8B is a schematic perspective view illustrating a thermal transfer portion in which the light sources are arranged sterically.

As illustrated in FIGS. 8A and 8B, luminaires 11*a* and 11*b* are each provided with the body portion 2, light sources 13, the globe 5, and thermal transfer portions 190 and 191 respectively. Although illustration is omitted, the cap portion 6 and the control unit 7 are also provided in the same manner as the luminaire 1 described above.

In this case, the forms of disposing the light sources 13 are different from those illustrated in FIG. 1 and FIG. 2.

As illustrated in FIG. 8A, in the luminaire 11*a*, three of the light sources 13 are provided on the end portion 2*a* of the body portion 2 via a substrate 18. In this case, the light sources 13 are provided respectively at positions of rotation symmetry with respect to a center axis 11*a*1 of the luminaire 11*a*.

As illustrated in FIG. 8B, in the luminaire 11*b*, a projection 2*c* is provided on the end portion 2*a* of the body portion 2.

The projection 2*c* has a regular triangular pyramid shape, and the light sources 13 are provided on inclined surfaces thereof respectively via the substrate 18. In this case, the light sources 13 are provided respectively at positions of rotation symmetry with respect to a center axis 11*b*1 of the luminaire 11*b*.

An apex of the projection 2*c* is provided at a position where the center axis 11*b*1 of the luminaire 11*b* passes.

In the luminaire 11*b* illustrated in FIG. 8B, since the light sources 13 are provided on the inclined surfaces of the projection 2*c*, optical axes of the respective light sources 13 intersect the center axis 11*b*1 of the luminaire 11*b*. However, the light sources 13 are provided respectively at the positions of rotation symmetry with respect to the center axis 11*b*1 of the luminaire 11*b*, the center axis 11*b*1 of the luminaire 11*b* corresponds to an optical axis of the luminaire 11*b*.

The projection 2*c* may be formed of a material having a high rate of thermal transfer, for example. The projection 2*c* may be formed of, for example, a metal such as aluminum (Al), copper (Cu), and an alloy thereof. However, the material of the projection 2*c* is not limited thereto, and may be formed of an inorganic material such as aluminum nitride (AlN) or an organic material such as a high thermal conductive resin. In this case, the projection 2*c* and the body portion 2 may be formed of the same material, or may be formed of different materials. Also, the projection 2*c* and the body portion 2 may be formed integrally, or the projection 2*c* and the body portion 2 may be joined via a material having a high rate of thermal transfer.

The light source 13 may be provided with one or more light-emitting elements 3*b* in the same manner as the light source 3. The number of the light-emitting elements 3*b* may be changed as needed in accordance with the application of the luminaires 11*a* and 11*b* and the size of the light-emitting elements 3*b*. In the luminaire 11*b* illustrated in FIG. 8B, one each of the light source 13 is provided on each of the three inclined surfaces of the projection 2*c* having the regular triangular pyramid shape.

The substrate 18 may be formed of a material having a high rate of thermal transfer in the same manner as the substrate 8. The substrate 18 may be formed of, for example, a metal such as aluminum (Al), copper (Cu), and an alloy thereof, and formed with a wiring pattern, not illustrated, on a surface thereof via an insulating layer.

The thermal transfer portion 190 provided on the luminaire 11*a* illustrated in FIG. 8A is thermally joined to at least either one of the globe 5 or the thermal radiating surface of the body portion 2 on the end portion 2*a* side.

In this case, the thermal transfer portion 190 may includes an end portion 190*a* thermally joined to the globe 5 at least partly, and an end portion 190*b* thermally joined to the end portion 2*a* of the body portion 2 at least partly. The end portion 190*a* corresponds to the end portion 9*a* of the thermal transfer portion 9 described above. The end portion 190*b* corresponds to the end portion 9*b* of the thermal transfer portion 9 described above. An end portion corresponding to the end portion 9*c* of the thermal transfer portion 9 described above may be provided in accordance with the size or the shape of the substrate 18.

The thermal transfer portion 191 provided on the luminaire 11*b* illustrated in FIG. 8B is thermally joined to at least either one of the globe 5 or the thermal radiating surface of the body portion 2 on the end portion 2*a* side.

In this case, the thermal transfer portion 191 may include an end portion 191*a* thermally joined to the globe 5 at least partly, and an end portion 191*b* thermally joined to the projection 2*c* at least partly. In this case, the end portion 191*b* may be thermally joined also to the end portion 2*a* of the body portion 2.

The end portion 191*a* corresponds to the end portion 9*a* of the thermal transfer portion 9 described above. Since the projection 2*c* may be considered to be thermally a part of the end portion 2*a* of the body portion 2, the end portion 191*b* corresponds to the end portion 9*b* of the thermal transfer portion 9 described above.

An end portion corresponding to the end portion 9*c* of the thermal transfer portion 9 described above may be provided in accordance with the size or the shape of the substrate 18.

Thermal joint between the end portions of the thermal transfer portions 190 and 191 and the counterpart is achieved by simply bringing into contact with each other. However, by joining the end portions of the thermal transfer portions 190 and 191 and the counterpart via the joint portion 80 containing a material having a high rate of thermal transfer, the thermal resistance may be reduced, and hence the cooling effect may be improved.

For example, in the same manner as the thermal transfer portion 9 described above, the joint portion 80 may be provided by joining the end portions of the thermal transfer portions 190 and 191 and the counterpart by soldering or by the high-conductive adhesive agent added with the ceramics filler having a high rate of thermal transfer.

The material of the thermal transfer portions 190 and 191 or the reflectance may be the same as the case of the thermal transfer portion 9 described above.

The thermal transfer portions 190 and 191 may have a form of a plate shape, or a form of a plurality of plate-shaped members intersecting each other. For example, the thermal transfer portions 190 and 191 illustrated in FIGS. 8A and 8B have a form of three of the plate-shaped members intersecting each other. Then, the light sources 13 are provided respectively in three areas partitioned by the plate-shaped members.

The thermal transfer portions 190 and 191 may have a form of rotation symmetry with respect to optical axes of the luminaires 11*a* and 11*b*.

In this case, as described above, since the center axes 11*a*1 and 11*b*1 of the luminaires 11*a* and 11*b* correspond to the optical axes of the luminaires 11*a* and 11*b*, the thermal transfer portions 190 and 191 may have a form of rotation symmetry with respect to the center axes 11*a*1 and 11*b*1 of the luminaires 11*a* and 11*b*.

Assuming that the thermal transfer portions 190 and 191 have the form of rotation symmetry with respect to the optical axes of the luminaires 11*a* and 11*b*, the brightness in the areas partitioned by the thermal transfer portions 190 and 191 may be equalized with respect to each other.

Therefore, the difference between the bright section and the dark section generated on the globe 5 may be reduced, so that the uneven brightness of the luminaires 11*a* and 11*b* may be reduced.

In the second embodiment as well, the same effects as those in the luminaire 1 may be enjoyed.

In the case of the luminaire 11*b*, since the optical axes of the respective light sources 13 intersect the center axis 11*b*1 of the luminaire 11*b*, widening of the light distribution angle is achieved.

By arranging the light sources 13 sterically as the luminaire 11*b*, the number of the light-emitting elements which can be provided may be increased in comparison with a case where the light sources 13 are arranged planarly as the luminaire 11*a*.

Subsequently, the thermal transfer portion will be described further in detail.

Figure 9A:
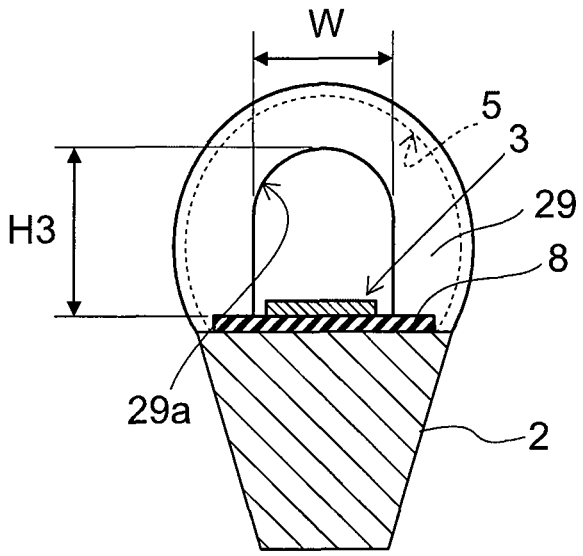
FIG. 9A is a partially cross-sectional schematic view illustrating the thermal transfer portion having an opening portion.
Figure 9B:
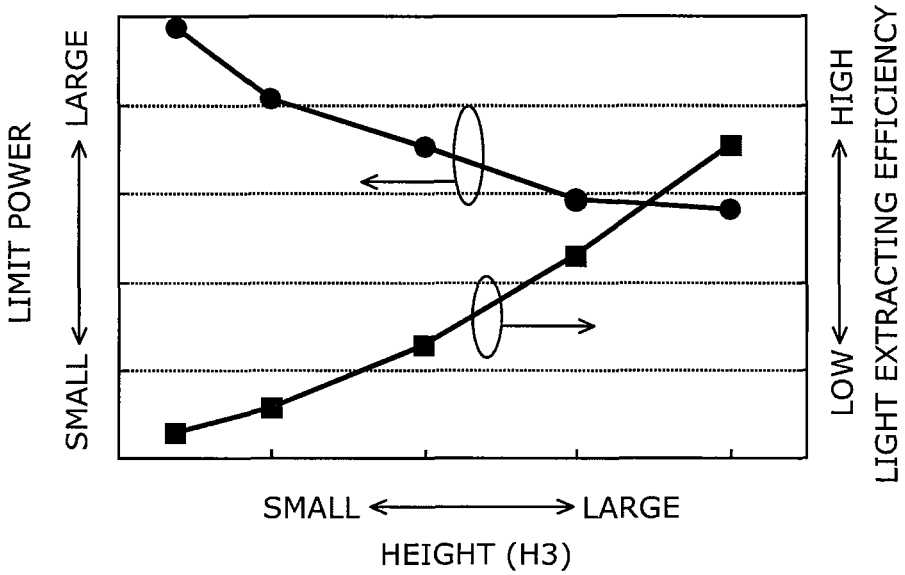
FIG. 9B is a schematic graph illustrating the effect of provision of the opening portion.

FIGS. 9A and 9B are schematic drawings illustrating a thermal transfer portion having an opening portion.

FIG. 9A is a partially cross-sectional schematic view illustrating the thermal transfer portion having the opening portion, and FIG. 9B is a schematic graph illustrating an effect of provision of the opening portion.

As illustrated in FIG. 9A, a thermal transfer portion 29 is provided with an opening portion 29*a* having a height H3.

The thermal transfer portion 29 has the opening portion 29*a* penetrating therethrough in the direction of the thickness thereof.

Here, as in the case illustrated in FIG. 1, when the light source 3 is provided at the end portion 2*a* of the body portion 2, the thermal transfer portion 29 is provided at a position where light radiated from the light source 3 is blocked.

In this case, by providing the opening portion 29*a*, the light radiated from the light source 3 may be inhibited from being blocked.

For example, as illustrated in FIG. 9B, light extracting efficiency may be improved by increasing the height H3 of the opening portion 29*a*. In FIG. 9B, the case where the height H3 of the opening portion 29*a* is changed is illustrated. However, a case where a width W of the opening portion 29*a* is changed is also the same. In other words, the light extracting efficiency may be improved also by increasing the width W of the opening portion 29*a*.

However, if the opening portion 29*a* is too large, there arises a risk that the amount of thermal transfer by the thermal transfer portion 29 and hence the amount of thermal radiation is reduced, so that the amount of light radiated from the light source 3 is reduced.

For example, by increasing the height H3 of the opening portion 29*a* as illustrated in FIG. 9B, the amount of thermal radiation from the thermal transfer portion 29 is reduced, so that limit power (power which can be supplied to the light-emitting elements 3*b*) is reduced. If the limit power is reduced, the amount of light radiated from the light source 3 is reduced correspondingly.

Therefore, the size of the opening portion 29*a* may be determined as needed considering the characteristics of the light-emitting elements 3*b*, improvement of the light extracting efficiency owing to the provision of the opening portion 29*a* and lowering of the thermal radiating property due to the provision of the opening portion 29*a*.

In FIG. 9A, the opening portion 29*a* opening at a peripheral edge of the thermal transfer portion 29 on the body portion 2 side is illustrated. However, the shape of the opening portion 29*a* and the position of provision of the opening portion 29*a* may be changed as needed.

However, by providing the opening portion 29*a* at a position closer to the light source 3, the light extracting efficiency may be improved. Therefore, the opening portion 29*a* opening at the peripheral edge of the thermal transfer portion on the body portion 2 side as illustrated in FIG. 9A is preferable.

Figure 10:
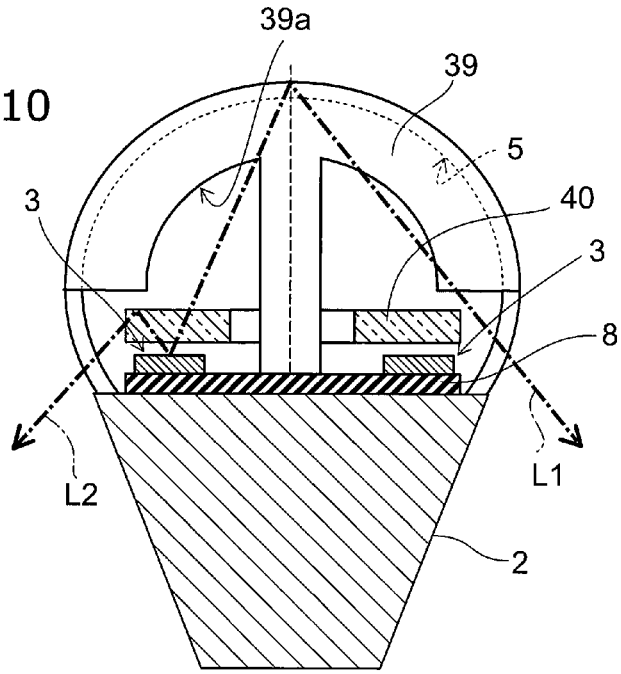
FIG. 10 is a partially cross-sectional schematic view illustrating an opening portion according to another embodiment.

FIG. 10 is a schematic partial cross-sectional view illustrating an opening portion according to another embodiment.

As illustrated in FIG. 10, an opening portion 39*a* provided on a thermal transfer portion 39 is opened at an end portion of the thermal transfer portion 39 on the body portion 2 side and an end portion of the globe 5 side. The thermal transfer portion 39 comes into contact with the substrate 8 on the center side, extends to the globe 5 side, and extends outward from an axis of the luminaire along the shape of the globe in the vicinity of the globe 5. The thermal transfer portion 39 has an "umbrella shape" in cross section including the axis of the luminaire.

Here, a state in which part of outgoing light from the light source 3 is propagated and reflected in the globe 5 is indicated by dashed lines (light L1 and L2) by projecting on the cross section in FIG. 10.

In this case, if employing the opening portion 39*a* opening on a peripheral edge of the thermal transfer portion 39 on the globe 5 side, the light L1 emitted from the light source 3 and reflected from an inner surface of the globe and the light L2 reflected from an end surface of a lens 40 are radiated backward of the luminaire as illustrated in FIG. 10. Therefore, improvement of the light extracting efficiency is achieved, and simultaneously, the light distribution angle may be widened.

The thermal transfer portion 39 may be formed entirely of a single plate as illustrated in FIG. 10. Alternatively, a plate-shaped member on a left half and a plate-shaped member on aright half are formed integrally, and the two plate-shaped members may be connected at a position indicated by a dot line portion in FIG. 10, for example. Alternatively, the plate-shaped member on the left half and the plate-shaped member on the right half of the thermal transfer portion 39 in FIG. 10 may be formed separately and connected along the dot line portion in FIG. 10. The thermal transfer portion 39 may be added with another separate plate-shaped member (not illustrated). The plate-shaped member to be added intersects or is connected to other plate-shaped members at the dot line portion illustrated in FIG. 10, and constitutes part of the thermal transfer portion 39.

The light sources 3 may be arranged in a circular shape. The light sources 3 may be provided in the vicinity of the globe 5.

As illustrated in FIG. 10, an optical element such as the annular lens 40 may easily be provided.

In this case, the position of the opening portion 39*a* opening at the peripheral edge of the thermal transfer portion 39 on the globe 5 side is not specifically limited.

However, as illustrated in FIG. 10, the light extracting efficiency may further be improved by forming the opening portion 39*a* at a position closer to the body portion 2, and the light distribution angle may be widened.

As described thus far, the opening portion may be formed so as to open at least either the peripheral edge of the thermal transfer portion on the body portion side or the peripheral edge of the thermal transfer portion on the globe 5 side.

Figure 11:
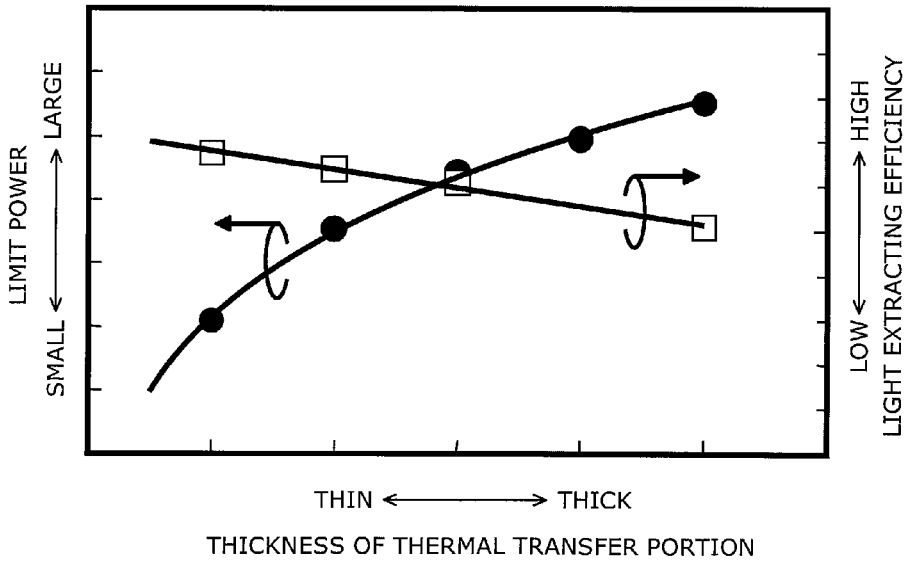
FIG. 11 is a schematic graph illustrating the thickness of the thermal transfer portion.

FIG. 11 is a schematic graph illustrating the thickness of the thermal transfer portion.

As illustrated in FIG. 11, the light extracting efficiency lowers by increase in thickness of the thermal transfer portion. In contrast, the amount of thermal radiation by the thermal transfer portion is increased with increase in thickness of the thermal transfer portion, and the limit power is increased correspondingly. Then, when the limit power is increased, the amount of light radiated from the light source 3 may be increased correspondingly.

Considering now the replacement of the existing incandescent lamp with the luminaire as described above, an outline dimension of the luminaire is preferably the same as that of the incandescent lamp as much as possible. Therefore, since the wideness of the area where the light source 3 and the thermal transfer portion are arranged is limited, if the thickness of the thermal transfer portion is increased too much, there is a risk that the number of the light-emitting elements 3*b* is reduced. Also, if the thickness of the thermal transfer portion is too thick, there arises a risk that the light extracting efficiency is lowered.

If the thickness of the thermal transfer portion is too thin, there arises a risk that manufacture of the thermal transfer portion becomes difficult. In such a case, the thermal transfer portion may be manufactured by, for example, die-casting.

Therefore, the thickness of the thermal transfer portion is preferably determined by considering the amount of thermal radiation by the thermal transfer portion, the wideness of the area where the light source 3 and the thermal transfer portion are arranged, and the manufacturability of the thermal transfer portion.

According to the knowledge obtained by the inventers, by selecting the thickness of the thermal transfer portion within a range from 0.5 mm to 5 mm inclusive, all of the amount of thermal radiation by the thermal transfer portion, the wideness of the area where the light source 3 and the thermal transfer portion are arranged, and the manufacturability of the thermal transfer portion are considered. By selecting the thickness of the thermal transfer portion within the range from 0.5 mm to 5 mm inclusive, 90% or more of light extracting efficiency is obtained.

In order to increase the amount of thermal transfer in the thermal transfer portion and thus the amount of thermal radiation, a thermal resistance at a connecting portion between the thermal transfer portion and the element provided on the body portion 2 side may be lowered.

Figure 12A:
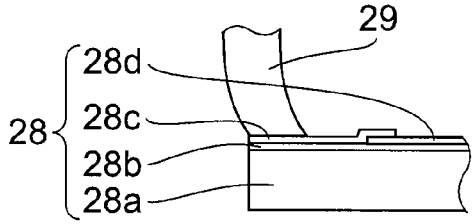
FIG. 12A is a schematic drawing illustrating a connecting portion between the thermal transfer portion and a substrate when reduction of thermal resistance is not considered.
Figure 12B:
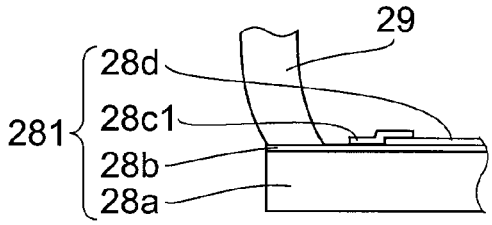
FIG. 12B is a schematic drawing illustrating the connecting portion between the thermal transfer portion and the substrate when the reduction of the thermal resistance is achieved.
Figure 12C:
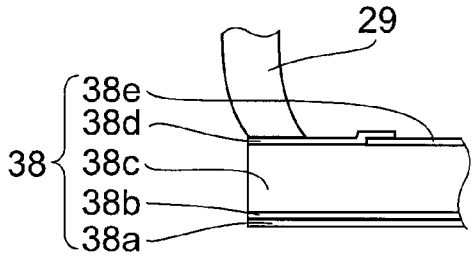
FIG. 12C is a schematic drawing illustrating the connecting portion between the thermal transfer portion and the substrate when the reduction of the thermal resistance is not considered.
Figure 12D:
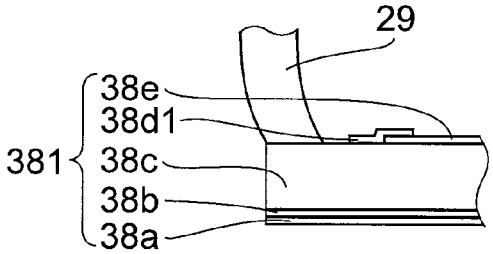
FIG. 12D is a schematic drawing illustrating the connecting portion between the thermal transfer portion and the substrate when the reduction of the thermal resistance is achieved.

FIGS. 12A to 12D are schematic drawings for illustrating the connecting portion between the thermal transfer portion and the substrate. FIGS. 12A and 12C illustrate a case where the lowering of the thermal resistance is not considered, and FIGS. 12B and 12D illustrate a case where the lowering of the thermal resistance is achieved.

As illustrated in FIG. 12A, a substrate 28 is provided with a substrate 28*a* formed of aluminum or copper, an insulating portion 28*b* provided on the substrate 28*a*, a solder resist portion 28*c* provided on the insulating portion 28*b*, and a wiring portion 28*d* provided on the insulating portion 28*b*. In other words, the substrate 28 is so-called a metal-base substrate.

The solder resist portion 28*c* may be formed by applying solder resist formed of a resin or the like by using a printing method and a photographic method.

However, since the solder resist portion 28*c* is formed by using the solder resist formed of the resin or the like, the thermal resistance at a connecting portion between the thermal transfer portion 29 and the substrate 28 is increased.

In contrast, as illustrated in FIG. 12B, a substrate 281 is provided with the substrate 28*a*, the insulating portion 28*b* provided on the substrate 28*a*, a solder resist portion 28*c*1 provided on the insulating portion 28*b*, and the wiring portion 28*d* provided on the insulating portion 28*b*.

In this case, a connecting portion between the thermal transfer portion 29 and the substrate 281 is not provided with the solder resist portion 28*c*1, and the thermal transfer portion 29 and the insulating portion 28*b* are connected. Therefore, the thermal resistance may be reduced by an amount corresponding to the solder resist portion 28*c*1.

When forming the solder resist portion 28*c*1, the solder resist portion 28*c*1 may not be formed in an area where the thermal transfer portion 29 is connected, or the solder resist portion 28*c*1 may be formed by separating the solder resist in the area where the thermal transfer portion 29 is connected.

As illustrated in FIG. 12C, a substrate 38 is provided with a solder resist portion 38*a*, a wiring portion 38*b* provided on the solder resist portion 38*a*, an insulating portion 38*c* provided on the wiring portion 38*b*, and a solder resist portion 38*d* provided on the insulating portion 38*c*, and a wiring portion 38*e* provided on the insulating portion 38*c*. In other words, the substrate 38 is so-called a resin substrate.

The solder resist portion 38*d* may be formed by applying the solder resist formed of the resin or the like by using the printing method and the photographic method.

However, since the solder resist portion 38*d* is formed by using the solder resist formed of the resin or the like, the thermal resistance at a connecting portion between the thermal transfer portion 29 and the substrate 38 is increased.

In contrast, as illustrated in FIG. 12D, a substrate 381 is provided with the solder resist portion 38*a*, the wiring portion 38*b* provided on the solder resist portion 38*a*, the insulating portion 38*c* provided on the wiring portion 38*b*, and a solder resist portion 38*d*1 provided on the insulating portion 38*c*, and the wiring portion 38*e* provided on the insulating portion 38*c*.

In this case, a connecting portion between the thermal transfer portion 29 and the substrate 381 is not provided with the solder resist portion 38*d*1, and the thermal transfer portion 29 and the insulating portion 38*c* are connected. Therefore, the thermal resistance may be reduced by an amount corresponding to the solder resist portion 38*d*1.

When forming the solder resist portion 38*d*1, the solder resist portion 38*d*1 may not be formed in an area where the thermal transfer portion 29 is connected, or the solder resist portion 38*d*1 may be formed by separating the solder resist in the area where the thermal transfer portion 29 is connected.

In other words, the solder resist portion formed of the solder resist may be avoided from being formed in a portion between an end portion of the thermal transfer portion 29 and the thermal radiating surface of the body portion 2 on the end portion 2*a* side.

For example, the solder resist portion using the solder resist may be provided so as to surround the area of the end portion 2*a* of the body portion 2 where the thermal transfer portion 29 is connected.

Although the description given above is a case where a member having a higher thermal resistance is not provided between the thermal transfer portion and the body portion 2 side, the lowering of the thermal resistance is not limited thereto. For example, the lowering of the thermal resistance is achieved by increasing a contact surface area by providing a seat portion, not illustrated, in the thermal transfer portion on the body portion 2 side, by bringing the thermal transfer portion and the body portion 2 side into tight contact by screwing or the like, or by providing a metal having a low thermal resistance or the like between the thermal transfer portion and the body portion 2 side.

Subsequently, a case where a diffusion portion is provided on the surface of the thermal transfer portion will be described.

The diffusion portion is provided so as to diffuse light incoming into the thermal transfer portion.

The diffusing portion may be at least either one of a projecting portion provided on the surface of the thermal transfer portion or a diffusing layer 70 (see FIG. 1B) containing a diffusing agent provided on the surface of the thermal transfer portion.

Figure 13A:
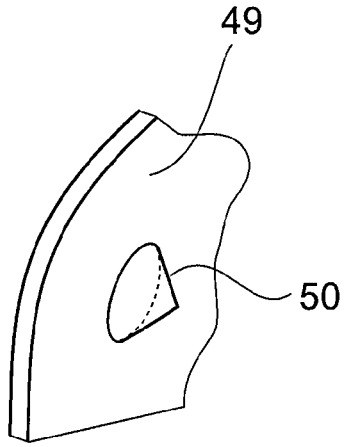
FIG. 13A is a schematic drawing illustrating a case where one projecting portion is provided on a surface of the thermal transfer portion.
Figure 13B:
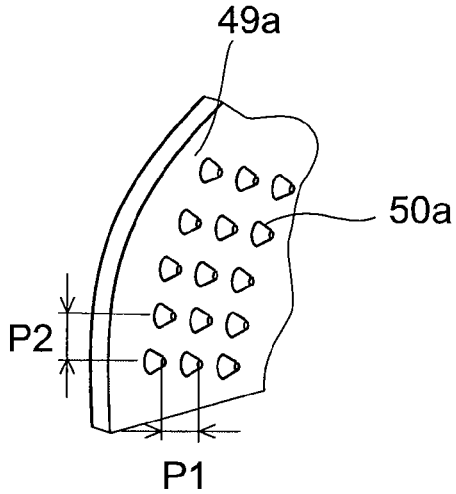
FIG. 13B is a schematic drawing illustrating a case where a plurality of the projecting portions are provided on the surface of the thermal transfer portion.

FIGS. 13A and 13B are schematic drawings illustrating the projecting portion or portions provided on the surface of the thermal transfer portion.

FIG. 13A shows a case in which one projecting portion is provided on the surface of a thermal transfer portion 49 and FIG. 13B illustrates a case where a plurality of the projecting portions are provided on the surface of a thermal transfer portion 49*a*.

If the projecting portion or portions are provided on the surface of the thermal transfer portion, light incoming into the thermal transfer portion may be diffused. If the light incoming into the thermal transfer portion can be diffused, the light distribution angle may be widened.

In this case, one projecting portion 50 may be provided on the surface of the thermal transfer portion 49 as illustrated in FIG. 13A and a plurality of projecting portions 50*a* may be provided on the surface of the thermal transfer portion 49*a* as illustrated in FIG. 13B.

If the plurality of projecting portions 50*a* are provided on the surface of the thermal transfer portion 49*a*, a regularly disposing form may be employed, and an arbitrary disposing form may also be employed.

When providing the plurality of projecting portions 50*a* on the surface of the thermal transfer portion 49*a*, pitches P1 and P2 of the projecting portions 50*a* are preferably set to 10 times or more a wavelength of light radiated from the light source 3 to avoid an interference fringe from being generated.

The shape of the projecting portion is not limited to those described above, but may be modified as needed.

The description given above relates to a case where the light incoming into the thermal transfer portion is diffused by providing the projecting portion or projecting portions on the surface of the thermal transfer portion. However, the diffusing layer 70 may be provided on the surface of the thermal transfer portion to cause the light incoming into the thermal transfer portion is caused to diffuse.

The diffusing layer 70 may be a resin layer or the like containing a diffusing agent which diffuses the light, for example. Examples of the diffusing agents include fine particles formed of metal oxide such as silicon oxide or titanium oxide, or fine particle polymer.

If the diffusing layer 70 is provided on the surface of the thermal transfer portion, light incoming into the thermal transfer portion may be diffused. If the light incoming into the thermal transfer portion can be diffused, the light distribution angle may be widened.

In FIGS. 13A and 13B, only one of the surfaces of the thermal transfer portion is illustrated. However, the projecting portion or portions or the diffusing layer may be provided on the other surface of the thermal transfer portion.

Subsequently, an arrangement of a thermal transfer portion 59 and the light-emitting elements 3*b* when viewed from above the luminaire, that is, an arrangement between the thermal transfer portion 59 and the light-emitting elements 3*b* in plan view will be described.

Figure 14A:
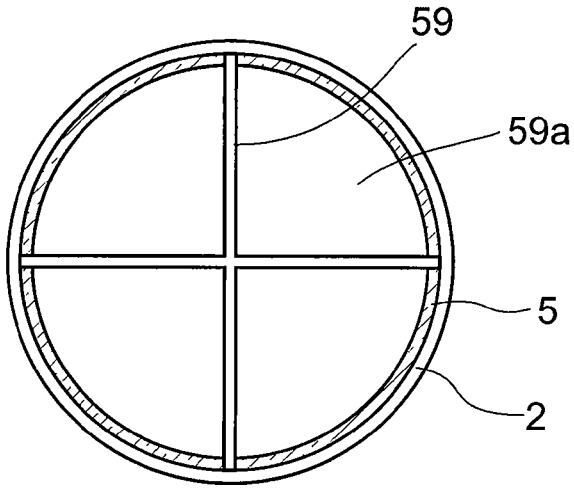
FIG. 14A is a schematic drawing illustrating the arrangement of the thermal transfer portion and light-emitting elements in plan view.
Figure 14B:
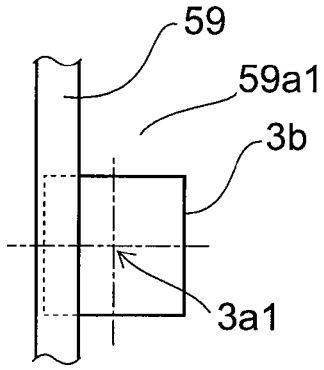
FIG. 14B is a schematic drawing illustrating the positional relationship between the thermal transfer portion and the light-emitting elements in plan view.

FIGS. 14A and 14B are schematic drawings illustrating the arrangement of the thermal transfer portion 59 and the light-emitting elements 3*b* in plan view.

FIG. 14A is a schematic drawing illustrating the arrangement of the thermal transfer portion 59 and the light-emitting element 3*b* in plan view, and FIG. 14B is a schematic drawing for illustrating the positional relationship between the thermal transfer portion 59 and the light-emitting element 3*b* in plan view.

As illustrated in FIG. 14A, by providing the thermal transfer portion 59, areas 59*a* partitioned by the thermal transfer portion 59 in plan view are formed.

In a case where the plurality of light-emitting elements 3*b* are provided, in order to inhibit an uneven light distribution or the uneven brightness, the numbers of the light-emitting elements 3*b* provided in the respective areas 59*a* are preferably the same. In this case, the thermal transfer portion 59 and the light-emitting elements 3*b* preferably do not overlap with each other in plan view.

However, according to the knowledge obtained by the inventors, even when there are the light-emitting elements 3*b* overlapping partly with the thermal transfer portion 59 in plan view, if the thermal transfer portion 59 and a center 3*a*1 of the light-emitting element 3*b* are arranged so as not to overlap, the uneven light distribution and the uneven brightness may be inhibited.

In this case, only setting the numbers of the light-emitting elements 3*b* having the position of the center 3*a*1 in the respective areas 59*a* partitioned by the thermal transfer portion 59 in plan view to be the same among the respective areas 59*a*.

For example, in FIG. 14B, the light-emitting element 3*b* is a light-emitting element provided in an area 59*a*1.

The thermal transfer portion preferably has a form of rotation symmetry with respect to the optical axis of the luminaire and the center axis of the luminaire. However, by setting the numbers of the light-emitting elements 3*b* having the position of the center 3*a*1 in the respective areas 59*a* partitioned by the thermal transfer portion 59 in plan view to be the same among the respective areas 59*a*, the thermal transfer portion does not have to have a form of rotation symmetry.

The positions where the light-emitting elements 3*b* are provided are not limited to the center side of the end portion 2*a* of the body portion 2 (for example the cases illustrated in FIG. 1 and FIG. 8). For example, the light-emitting elements 3*b* may be provided on the peripheral side of the end portion 2*a* of the body portion 2 or, alternatively, the light-emitting elements 3*b* may be provided in the entire area of the end portion 2*a* of the body portion 2.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions. Moreover, above-mentioned embodiments can be combined mutually and can be carried out.

For example, the shapes, the dimensions, the materials, the arrangements, and the numbers of the elements provided in the luminaire 1 and the luminaires 11*a* and 11*b* are not limited to those described above, and may be modified as needed.

What is claimed is:

1. A luminaire comprising:
- a body portion;
- a light source provided at one end portion of the body portion and having a light-emitting element;
- a globe provided so as to cover the light source; and
- a thermal transfer portion thermally joined to at least either one of the globe or a thermal radiating surface of the body portion on the end portion side,
- wherein an end surface of the thermal transfer portion on the globe side is exposed from the globe.

2. The luminaire according to claim 1, wherein the thermal transfer portion has a shoulder portion having at least either one of a projecting form projecting in the direction of the thickness of the thermal transfer portion or a depressed form depressed in the direction of the thickness of the thermal transfer portion at an end portion on the globe side.

3. The luminaire according to claim 1, wherein the globe is partitioned at a portion where the thermal transfer portion is exposed from the globe.

4. The luminaire according to claim 1, wherein the thermal transfer portion has an opening portion penetrating therethrough in the direction of the thickness.

5. The luminaire according to claim 4, wherein the opening portion is formed so as to open at least either an end portion of the thermal transfer portion on the body portion side and an end portion of the thermal transfer portion on the globe side.

6. The luminaire according to claim 1, wherein the thermal transfer portion has a reflectance ratio higher than that of the globe.

7. The luminaire according to claim 1, further comprising a diffusing portion provided on a surface of the thermal transfer portion and configured to diffuse light incoming into the thermal transfer portion.

8. The luminaire according to claim 7, wherein the diffusing portion is at least either one of a projecting portion provided on the surface of the thermal transfer portion or a diffusing layer containing a diffusing agent provided on the surface of the thermal transfer portion.

9. The luminaire according to claim 1, wherein a plurality of the light-emitting elements are provided, and
- the numbers of the light-emitting elements having a center position thereof located in respective areas partitioned by the thermal transfer portion are the same in plan view among the respective areas.

10. The luminaire according to claim 1, wherein the thermal transfer portion has a form of rotation symmetry with respect to at least either one of an optical axis of the luminaire or a center axis of the luminaire.

11. The luminaire according to claim 1, wherein at least part of an end portion of the thermal transfer portion on the body portion side and the thermal radiating surface of the body portion on the end portion side are in contact with each other.

12. A luminaire comprising:
- a body portion;
- a light source provided at one end portion of the body portion and having a light-emitting element;
- a globe provided so as to cover the light source; and
- a thermal transfer portion thermally joined to at least either one of the globe or a thermal radiating surface of the body portion on the end portion side and having a form in which a plurality of plate shaped members intersect each other,
- wherein an end surface of the thermal transfer portion on the globe side is exposed from the globe.

13. The luminaire according to claim 12, wherein the thermal transfer portion has a shoulder portion having at least either one of a projecting form projecting in the direction of the thickness of the thermal transfer portion or a depressed form depressed in the direction of the thickness of the thermal transfer portion at an end portion on the globe side.

14. The luminaire according to claim 12, wherein the globe is partitioned at a portion where the thermal transfer portion is exposed from the globe.

15. The luminaire according to claim 12, wherein the thermal transfer portion has an opening portion penetrating therethrough in the direction of the thickness.

16. A luminaire comprising:
- a body portion;
- a substrate provided at one end of the body portion, and includes a light emitting element;
- a globe covering the light emitting element; and
- a thermal transfer portion having better thermal conductivity than the globe and thermally joined to the substrate, the thermal transfer portion including at least one curved structure configured to provide a sealed enclosure for the light emitting element together with the globe, the curved structure having an exterior surface extending from an outer periphery of the substrate to an apex of the globe.

17. The luminaire according to claim 16, wherein the thermal transfer portion includes a plurality of curved structures each having an exterior surface extending from an outer periphery of the substrate to an apex of the globe.

18. The luminaire according to claim 17, wherein each of the curved structures are thermally joined to the body portion.

19. The luminaire according to claim 17, wherein each of the curved structures includes a step portion at portions contacting the globe.

20. The luminaire according to claim 17, wherein each of the curved structures includes a reflecting layer for reflecting light emitted from the light emitting element.

* * * * *